United States Patent [19]

Aoki

[11] Patent Number: 4,458,395

[45] Date of Patent: Jul. 10, 1984

[54] MAGNET CLASP

[76] Inventor: Yoshihiro Aoki, 2-9-16, Hanahata, Adachi-ku, Tokyo, Japan, 121

[21] Appl. No.: 442,046

[22] Filed: Nov. 16, 1982

Related U.S. Application Data

[62] Division of Ser. No. 264,769, May 18, 1981.

[51] Int. Cl.[3] ..... E05C 17/56; H01F 3/12

[52] U.S. Cl. ..... 24/303; 292/251.5; 335/236

[58] Field of Search ..... 24/303, 201 B, 136 R; 248/206 A; 335/236; 292/DIG. 55, 251.5

[56] References Cited

U.S. PATENT DOCUMENTS

| | | | |
|---|---|---|---|
| 2,288,688 | 7/1942 | Dubilier | 292/251.5 |
| 2,585,714 | 2/1952 | Wrobel et al. | 335/236 |
| 2,901,278 | 8/1959 | Robinson | 292/251.5 |
| 2,955,239 | 10/1960 | Rouse | 292/251.5 |
| 3,277,681 | 10/1966 | Bey | 24/201 B |
| 4,021,891 | 5/1977 | Morita | 292/251.5 |
| 4,219,062 | 8/1980 | Berkman | 24/303 |
| 4,265,002 | 5/1981 | Hosken | 24/201 B |
| 4,310,188 | 1/1982 | Aoki | 292/251.5 |

FOREIGN PATENT DOCUMENTS

| | | | |
|---|---|---|---|
| 1068149 | 10/1959 | Fed. Rep. of Germany | 292/251.5 |

*Primary Examiner*—Victor N. Sakran

*Attorney, Agent, or Firm*—Wenderoth, Lind & Ponack

[57] ABSTRACT

A magnet clasp a stationary part and a movable part, the stationary part including a permanent magnet, ferromagnetic plates secured to the permanent magnet, a ferromagnetic pillar and a non-magnetic case and cover which encase and cover the permanent magnet and associated parts, while the movable part has a ferromagnetic plug adapted to received by a central hole of the stationary part. The magnetic attracting force acts between the permanent magnet and the ferromagnetic plug to firmly hold the stationary and movable parts only when the ferromagnetic plug is placed in the central hole of the stationary part, whereas, when the ferromagnetic plug is placed on other portions of the stationary part, no substantial magnetic attracting force is exerted.

8 Claims, 10 Drawing Figures

MAGNET CLASP

This is a divisional application of applicant's co-pending application Ser. No. 264,769, filed May 18, 1981.

BACKGROUND OF THE INVENTION

The present invention relates to a magnet clasp comprising and, more particularly, to a magnet clasp of the type having a stationary part incorporating a permanent magnet having a central hole for receiving a movable part constituted by a plug, wherein the movable part can make a close and tight contact with the stationary part only when it correctly fits the central hole of the stationary part.

Hitherto, various types of magnet clasps have been proposed and known. In these known magnet clasps the magnetic attracting force produced by the magnetic force of the permanent magnet is developed over the entire surface of the stationary part, not only in the central part of the stationary part. Therefore, the movable part of the clasp is attracted by the stationary part even when it is not correctly positioned on the stationary part, i.e. even when the plug is placed on the surface of the peripheral portion of the stationary member. This makes it difficult to correctly and smoothly fit the plug in the central hole of the stationary member. Namely, for fitting the plug into the central hole, it is necessary to slide the plug on the surface of the stationary member from the peripheral portion to the central portion while the plug is being magnetically attracted by the stationary member, so that the surface of the stationary member is scratched and damaged to deteriorate the appearance thereof.

SUMMARY OF THE INVENTION

Accordingly, an object of the invention is to provide an improved clasp which can overcome the above-described problem of the prior art.

To this end, according to the invention, there is provided a magnet clasp comprising a stationary part including a permanent magnet, a ferromagnetic plate and a ferromagnetic pillar and being covered by a case and a cover of non-magnetic material, the movable part having a plug made of a ferromagnetic material, whereby the movable part is magnetically attracted and held by the stationary part only when it is received by an opening or hole of the stationary part whereas, when the movable part takes other position on the stationary part, it is not attracted by the stationary part.

The above and other objects, as well as advantageous features of the invention will become clear from the following description of the preferred embodiments taken in conjunction with the accompanying drawings.

DESCRIPTION OF THE PREFERRED EMBODIMENTS

Figure 1:
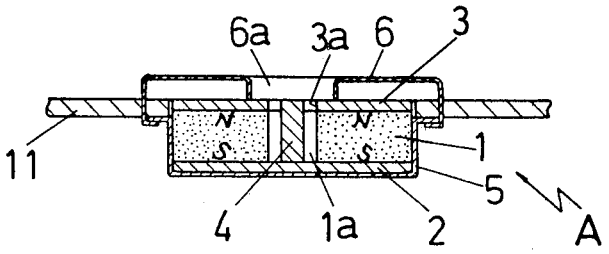
FIG. 1 is a front elevational sectional view of a stationary part of a magnet clasp in accordance with the invention.
Figure 3:
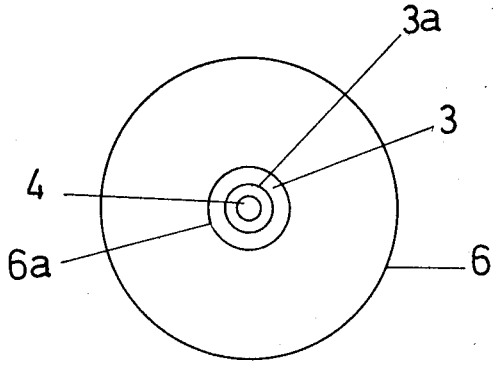
FIG. 3 is a plan view of the stationary part.
Figure 4:
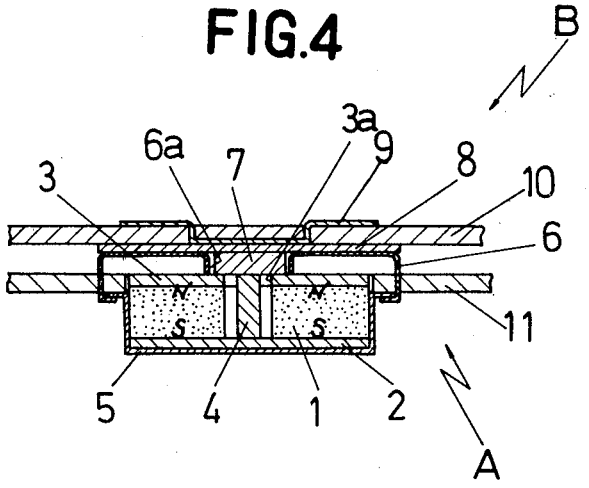
FIG. 4 is a schematic front elevational sectional view of the magnet clasp in accordance with the invention in the state of use.
Figure 5:
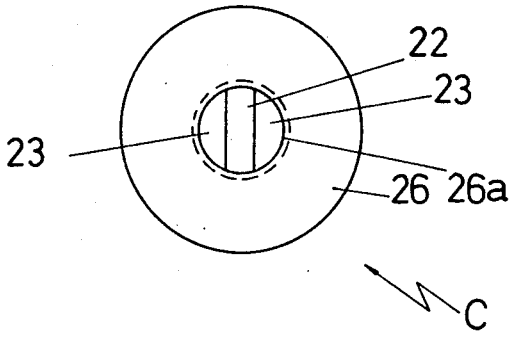
FIG. 5 is a plan view of the stationary part of a magnet clasp in accordance with another embodiment of the invention.
Figure 6:
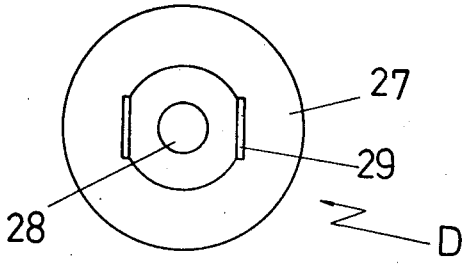
FIG. 6 is a plan view of the movable part of the magnet clasp having the stationary part shown in FIG. 5.
Figure 7:
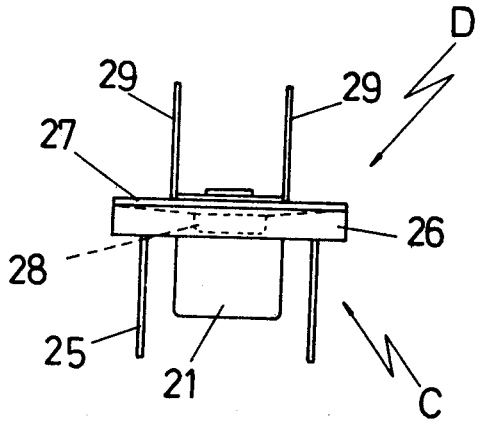
FIG. 7 is a schematic front elevational view showing the magnetic clasp of the embodiment shown in FIG. 5 in which the stationary part and the movable part are held by each other.
Figure 8:
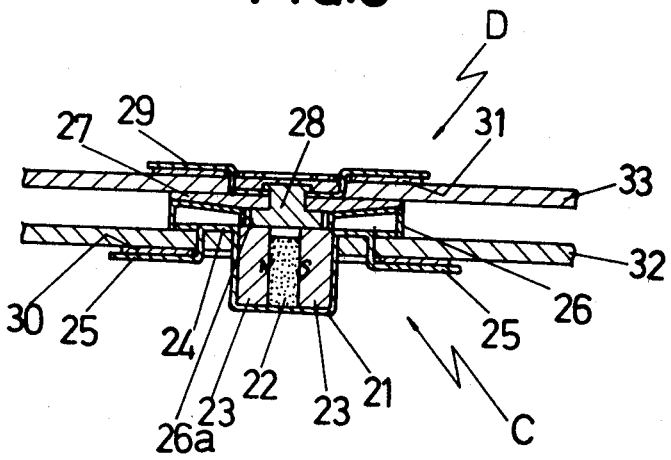
FIG. 8 is a schematic front elevational sectional view of the magnetic clasp shown in FIG. 7 in the state of use.

Referring to the drawings, particularly to FIGS. 1, 3 and 4, a magnet clasp in accordance with an embodiment of the invention has a stationary part generally designated at A and constituted by an annular permanent magnet 1, circular iron plate 2, annular iron plate 3, iron pillar 4, a bottom-equipped cylindrical case 5 made of brass which is a non-magnetic material, and an annular cover 6 which is also made of brass.

The iron plate 2 and the iron plate 3 are secured to the lower side and the upper side of the magnet 1, respectively. The iron pillar 4 mounted on the central portion of the iron plate 2 extends through a central hole 1*a* of the magnet 1 with a slight annular gap formed between the inner peripheral surface of the central hole 1*a* and the outer peripheral surface of the iron pillar 4.

The portion of the stationary part A other than the central hole 6*a* is covered by the case 5 and the cover 6. The stationary part A thus assembled is attached to the body 11 of a leather craft such as a handbag.

Figure 2:
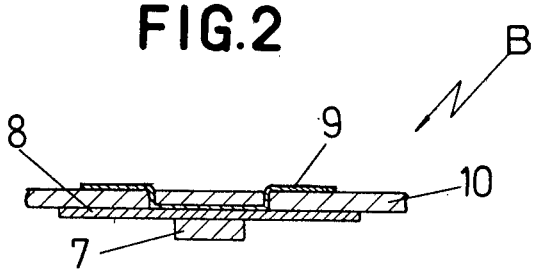
FIG. 2 is a front elevational sectional view of a movable part of the magnet clasp in accordance with the invention.

The magnet clasp has also a movable part B attached for example, to the cover portion 10 of the leather craft and constituted by a plug 7 made of a ferromagnetic iron, a disc member 8 made of iron, brass or a plastic, and an attaching member 9, as will be seen from FIGS. 2 and 4.

The annular iron plate 3 has a surface which is flush with the upper end surface of the iron pillar 4. The annular cover 6 has a certain thickness and the central hole 6*a* thereof is aligned with the central holes 1*a*, 3*a*. Therefore, when the movable part B and the stationary part A take the correct positional relationship with the attaching disc 8 contacting the upper surface of the cover 6, the plug 7 is received by the central hole 6*a* with its lower end contacting the upper end surface of the iron pillar 4 and the inner peripheral edge of the upper surface of the iron plate 3 so as to form a magnetic path. As a result, the lower face of the disc 8 of the movable part B is held in close contact with the upper surface of cover 6 by the magnetic attracting force so that the cover 10 of the hand bag is magnetically held in contact with the body 11 of the handbag.

Since the annular magnet 1 is wholly covered by the cover 6 and the cylindrical case 5 made of non-magnetic brass, no substantial magnetic path is formed at portions or area other than the holes 1*a*,6*a*. Namely, the magnetic attracting force is not exerted by the area other than the holes 1*a*,6*a*, so that the iron plug 7 is never attracted by the peripheral portion of the stationary part A around the central hole 6*a* of the cover 6. In consequence, the undesirable sliding of the plug 7 on the surface of the cover 6 under application of the magnetic force is avoided to prevent the scratching or damaging of the surface of the cover 6. Thus, the stationary part A and the movable part B can perform in combination, a perfect clasping function without being accompanied by the aforesaid problems of the prior art.

FIGS. 5,6,7 and 8 discloses a magnet clasp which is constructed in accordance with another embodiment of the invention. In this embodiment, the stationary part C has a bottom-equipped cylindrical case 21 made of a non-magnetic material, a permanent magnet 22, two ferromagnetic semicircular pillars 23,23 and a funnel-shaped cap 26. On the other hand, the movable part D is constituted by a disc 27 made of a non-magnetic material, a plug 28 made of iron which is a ferromagnetic material and an attaching member 29.

In this embodiment, the attracting force produced by the permanent magnet 22 acts locally only around the opening of the case 21. Therefore, the plug 28 is never attracted when it is merely placed on the tapered surface of the funnel-shaped cap 26 secured to the body 32 of the leather craft and, accordingly, it can lightly move on the tapered surface without damaging the latter. Then, as the plug 28 is guided by the tapered surface of the cap to the central hole 26*a*, the attracting force comes into effect for the first time to make the lower face of the plug 28 closely contact the upper faces of the semicylindrical pillars 23,23. In consequence, the stationary part C and the movable part D, which are secured to the body and the cover of the leather craft, cooperate with each other to perform the desired clasping function.

Figure 9:
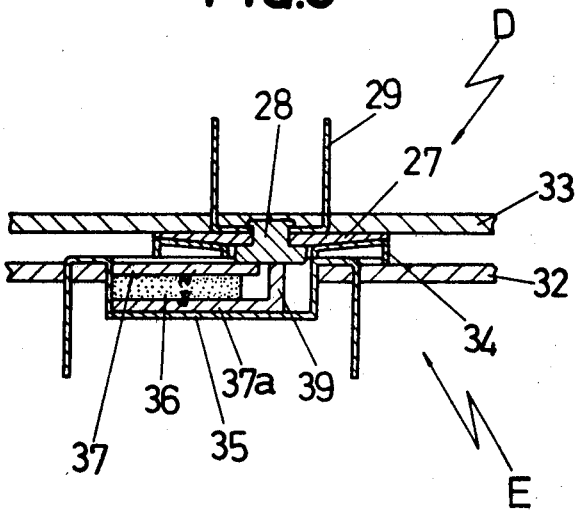
FIGS. 9 and 10 are schematic front elevational sectional view of different embodiments.

FIG. 9 shows still another embodiment of the invention in which the stationary part E has a funnel-shaped cap 34 made of a non-magnetic material, case 35, laterally orientated permanent magnet 36, ferromagnetic plates 37,37*a* and an upright member 39. The movable member D of the same construction as that of the preceding embodiment can fit in the central hole of the case 35.

Figure 10:
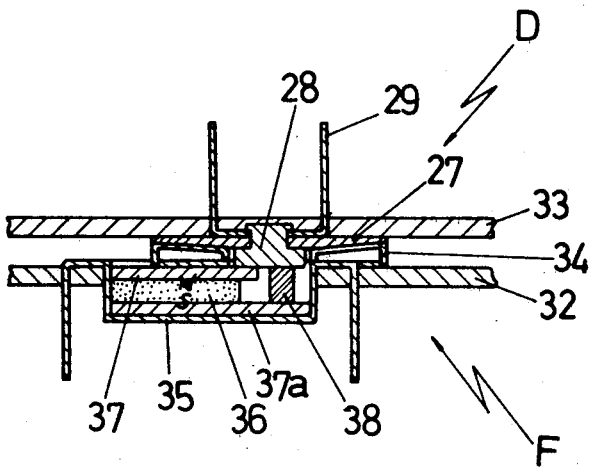

FIG. 10 shows a further embodiment of the invention in which the upright member 39 in the embodiment shown in FIG. 9 is replaced by an auxiliary pole 38 of the ferromagnetic member and vertically secured to the ferromagnetic plate 37*a* in horizontally spaced relation to magnet 36 and ferromagnetic plate 37. This stationary part has a lower opening engageable with the movable part D of the same construction as that of the embodiment shown in FIG. 9. The arrangement shown in FIG. 10 is advantageous in that the decrease in the absorbing force due to saturation of magnetism is avoided because the auxiliary magnetic pole 39 can have a sufficiently large cross-sectional area. It is, therefore, possible to obtain a higher attracting and fixing force between the stationary part F and the movable part D.

In the magnet clasps of the invention heretofore described, the movable part is strongly attracted by the stationary part only when it is fitted in the opening of the latter. In other words, no substantial magnetic attracting force is applied to the movable part when the latter is placed on the other portion of the stationary part than the central hole or opening. Therefore, the undesirable damaging of the surface of the stationary part, which is inevitable in the prior art due to the magnetic attraction between the stationary part and the movable part, is perfectly avoided to ensure and preserve the good appearance of the surface of the stationary part.

Needless to say, the stationary part, permanent magnet, and the movable part can have any desired shapes other than those stated in the specification and illustrated in the drawings.

Other changes and modifications are possible without departing from the spirit or scope of the invention which is limited solely by the appended claims.

What is claimed is:

1. A magnet clasp, comprising:

a stationary part, said stationary part including:

a nonmagnetic case having a closed bottom and an open top, a permanent magnet located within said case, having a first upper surface and a first lower surface, a first ferromagnetic plate having a first end, located on said closed bottom, and being secured to said first lower surface, and a nonmagnetic funnel-shaped cap defining a vertical hole providing a magnetic gap located directly above said first end, said cap and said case together completely enclosing said first ferromagnetic plate, and said permanent magnet except said first end at said vertical hole;

a movable part, said movable part including a ferromagnetic plug having a bottom surface, fittable into said vertical hole; and means formed of ferromagnetic material, for establishing a magnetic connection through said vertical hole between said first end of said first ferromagnetic plate and said plug at said bottom surface when said plug is fitted into said vertical hole, such that said movable part is held firmly to said stationary part by a magnetic attracting force only when said plug is fitted into said vertical hole.

2. A magnetic clasp as in claim 1, wherein said means formed of magnetic material comprises a ferromagnetic pole piece fixed to and projecting upward from said first end of said first plate in horizontal spaced relation to said permanent magnet.

3. A magnetic clasp as in claim 2, further comprising a second ferromagnetic plate, having a small second end, having a second upper surface, and being secured to said first upper surface, said small second end projecting beneath said vertical hole spaced horizontally from said ferromagnetic pole piece, said pole piece having a third upper surface, said bottom surface of said plug being flush with said second upper surface only at said second end, and with said third upper surface, when said said plug is fitted into said vertical hole.

4. A magnetic clasp as in claim 3, wherein said second and third upper surfaces are located in a same horizontal plane.

5. A magnetic clasp as in claim 2, wherein said pole piece is integral with said first ferromagnetic plate.

6. A magnetic clasp as in claim 2, wherein said pole piece and first ferromagnetic plate are separately formed elements.

7. A magnet clasp, comprising:

a stationary part, said stationary part including:

a nonmagnetic case having a closed bottom and an open top, a permanent magnet located within said case, having a first upper surface and a first lower surface, a first ferromagnetic plate having a first end, located on said closed bottom, and being secured to said first lower surface, and a funnel-shaped cap defining a vertical hole providing a magnetic gap located directly above said first end, said cap and said case together completely enclosing said first ferromagnetic plate, and said permanent magnet except said first end at said vertical hole;

a movable part, said movable part including a ferromagnetic plug having a bottom surface, fittable into said vertical hole;

means, including a ferromagnetic pole piece fixed to and projecting upward from said first end of said first plate in horizontal spaced relation to said permanent magnet, for establishing a magnetic connection through said vertical hole between said first end of said first ferromagnetic plate and said plug at said bottom surface when said plug is fitted into said vertical hole, such that said movable part is held firmly to said stationary part by a magnetic attracting force only when said plug is fitted into said vertical hole; and a second ferromagnetic plate, having a small second end, having a second upper surface, and being secured to said first upper surface, said small second end projecting beneath said vertical hole spaced horizontally from said ferromagnetic pole piece, said pole piece having a third upper surface, said bottom surface of said plug being flush with said second upper surface only at said second end, and with said third upper surface, when said plug is fitted into said vertical hole.

8. A magnetic clasp as in claim 7, wherein said second and third upper surfaces are located in a same horizontal plane.

* * * * *